US011035358B2

(12) United States Patent
Kwak et al.

(10) Patent No.: US 11,035,358 B2
(45) Date of Patent: Jun. 15, 2021

(54) VARIABLE DISPLACEMENT RECIPROCATING PISTON UNIT GENERATING PISTON STROKE SPEED AND PISTON STROKE LENGTH SIGNAL

(71) Applicants: TE Connectivity Germany GmbH, Bensheim (DE); Hanon Systems, Daejeon (KR)

(72) Inventors: Jung Myung Kwak, Daejeon (KR); Yong-Hee Kim, Daejeon (KR)

(73) Assignees: TE CONNECTIVITY GERMANY GMBH, Bensheim (DE); HANON SYSTEMS, Daejeon (KR)

( * ) Notice: Subject to any disclaimer, the term of this patent is extended or adjusted under 35 U.S.C. 154(b) by 0 days.

(21) Appl. No.: 16/803,138

(22) Filed: Feb. 27, 2020

(65) Prior Publication Data

US 2020/0277949 A1 Sep. 3, 2020

(30) Foreign Application Priority Data

Feb. 28, 2019 (EP) ..... 19159899

(51) Int. Cl.
*F04B 51/00* (2006.01)
*F04B 53/14* (2006.01)

(52) U.S. Cl.
CPC ..... *F04B 51/00* (2013.01); *F04B 53/14* (2013.01)

(58) Field of Classification Search
CPC .. F04B 51/00; F04B 53/14; F04B 2201/0201; F04B 49/065; F04B 2201/0202
See application file for complete search history.

(56) References Cited

U.S. PATENT DOCUMENTS 5,046,927 A * 9/1991 Ohno ..... F04B 27/1804 417/222.2
6,991,435 B2 * 1/2006 Ochiai ..... F04B 27/1804 417/222.1
2007/0089599 A1 * 4/2007 Fukuda ..... F04B 51/00 91/499

FOREIGN PATENT DOCUMENTS

DE 4033422 A1 4/1992
JP 0311172 A 1/1991
JP 2003148355 A * 5/2003
JP 2003148355 A 5/2003
(Continued)

OTHER PUBLICATIONS

European Search Report, Application No. 19159899.4, dated Sep. 5, 2019, 17 pages.
(Continued)

*Primary Examiner* — Abiy Teka

(57) ABSTRACT

A variable displacement reciprocating piston unit includes a sensor probe, a target, a piston having a top dead center position and a bottom dead center position, and a signal processing unit. The sensor probe, the target, and the piston are located in relation to each other so that the target is moved from being absent from the sensor probe to being present at the sensor probe when the piston travels towards the top dead center position, and the target is moved from being present at the sensor probe to being absent from the sensor probe when the piston travels towards the bottom dead center position. The signal processing unit generates a signal indicating a stroke speed and a stroke length of the piston from a signal from the sensor probe indicating a presence and/or an absence of the target as the target moves relative to the sensor probe.

17 Claims, 11 Drawing Sheets

(56) References Cited

FOREIGN PATENT DOCUMENTS

| | | | |
|---|---|---|---|
| JP | 2011149287 A | * | 8/2011 |
| JP | 2011149287 A | | 8/2011 |

OTHER PUBLICATIONS

Abstract of JP2003148355, dated May 21, 2003, 1 page.
Abstract of JP3011172, dated Jan. 18, 1991, 1 page.
Abstract of JP2011149287, dated Aug. 4, 2011, 1 page.
Abstract of DE4033422, dated Apr. 23, 1992, 2 pages.

* cited by examiner

VARIABLE DISPLACEMENT RECIPROCATING PISTON UNIT GENERATING PISTON STROKE SPEED AND PISTON STROKE LENGTH SIGNAL

CROSS-REFERENCE TO RELATED APPLICATION

This application claims the benefit of the filing date under 35 U.S.C. § 119(a)-(d) of European Patent Application No. 19159899.4, filed on Feb. 28, 2019.

FIELD OF THE INVENTION

The present invention relates to a piston unit and, more particularly, to a variable displacement reciprocating piston unit generating a signal indicating current piston stroke speed and piston stroke length.

BACKGROUND

U.S. Pat. No. 6,991,435 B2 relates to a variable displacement compressor including a processing unit estimating an inclination angle of a swash plate based on an output signal of a sensor.

SUMMARY

A variable displacement reciprocating piston unit includes a sensor probe, a target, a piston having a top dead center position and a bottom dead center position, and a signal processing unit. The sensor probe, the target, and the piston are located in relation to each other so that the target is moved from being absent from the sensor probe to being present at the sensor probe when the piston travels towards the top dead center position, and the target is moved from being present at the sensor probe to being absent from the sensor probe when the piston travels towards the bottom dead center position. The signal processing unit generates a signal indicating a stroke speed and a stroke length of the piston from a signal from the sensor probe indicating a presence and/or an absence of the target as the target moves relative to the sensor probe.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
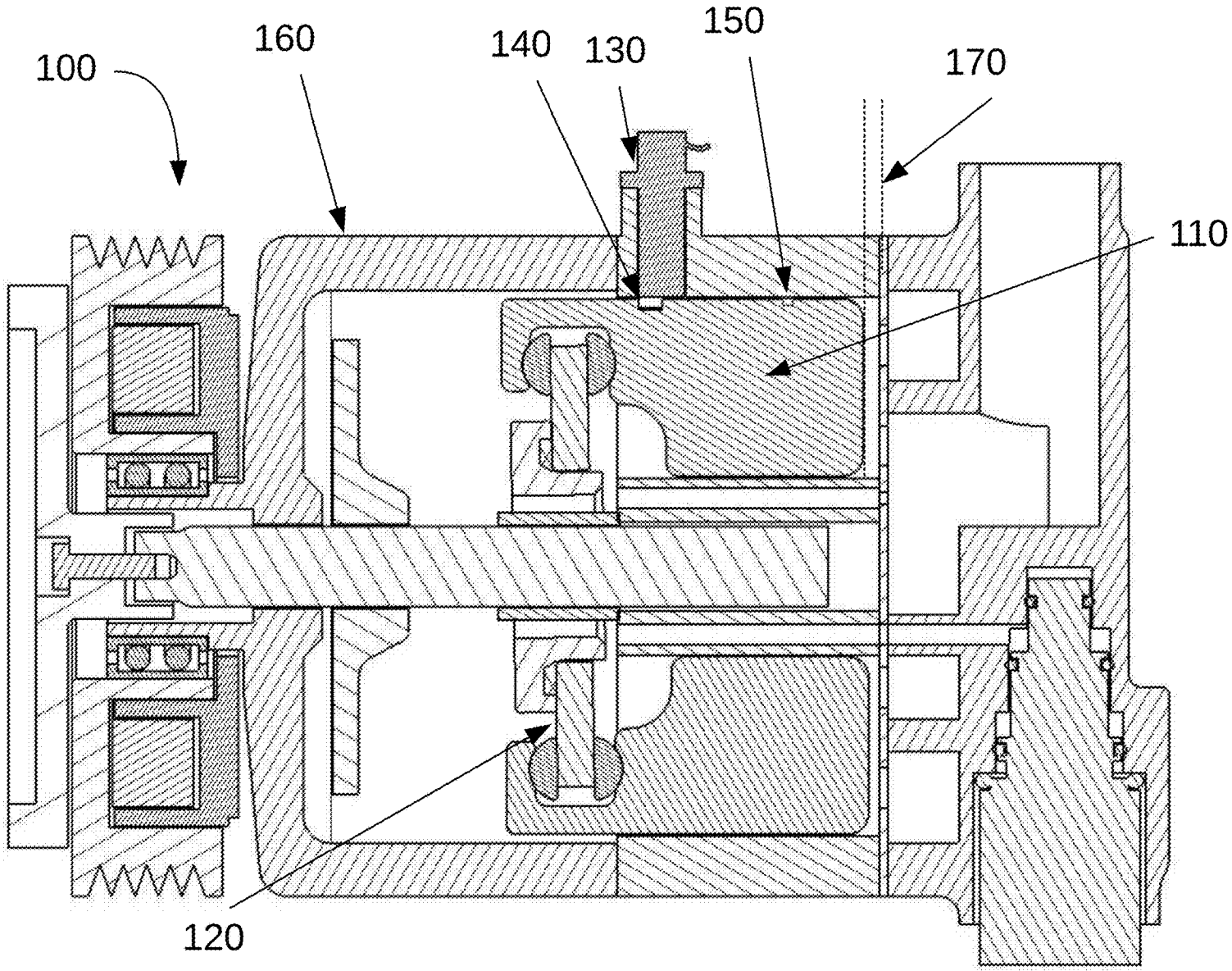
FIG. 1 is a sectional side view of a variable displacement compressor according to one embodiment of the invention in a short stroke length operation.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will convey the concept of the invention to those skilled in the art.

In the following, the variable displacement reciprocating piston unit will be described in the context of a variable displacement compressor 100. However, this is only an example to give context to the invention. It is obvious to the skilled person that the invention may be applied to any variable displacement reciprocation piston unit, machine and/or aggregate, such as a variable displacement compressor or pump.

A variable displacement compressor 100 according to an embodiment, also referred to as a variable displacement reciprocating piston unit 100 as described above, is shown in FIG. 1 in a reduced stroke length operation 170 for generating a signal indicating a stroke speed and a stroke length as described herein. The variable displacement compressor 100 comprises a piston 110, a sensor probe 130, and a target 140. The compressor 100, in the shown embodiment, further comprises a swash plate 120, a calibration target 150, and a housing 160.

A processing unit (not shown) may be part of the sensor probe 130, part of the controller, or of the compressor 100 or separate component. The processing unit may be implemented in a dedicated processing unit, or be a module of a general vehicle controller, such as compressor control unit or module and/or part of a Heating Ventilation and Air Conditioning (HVAC) system or the engine control unit. The sensor probe 130 may be attached to a housing of a compressor.

Figure 2:
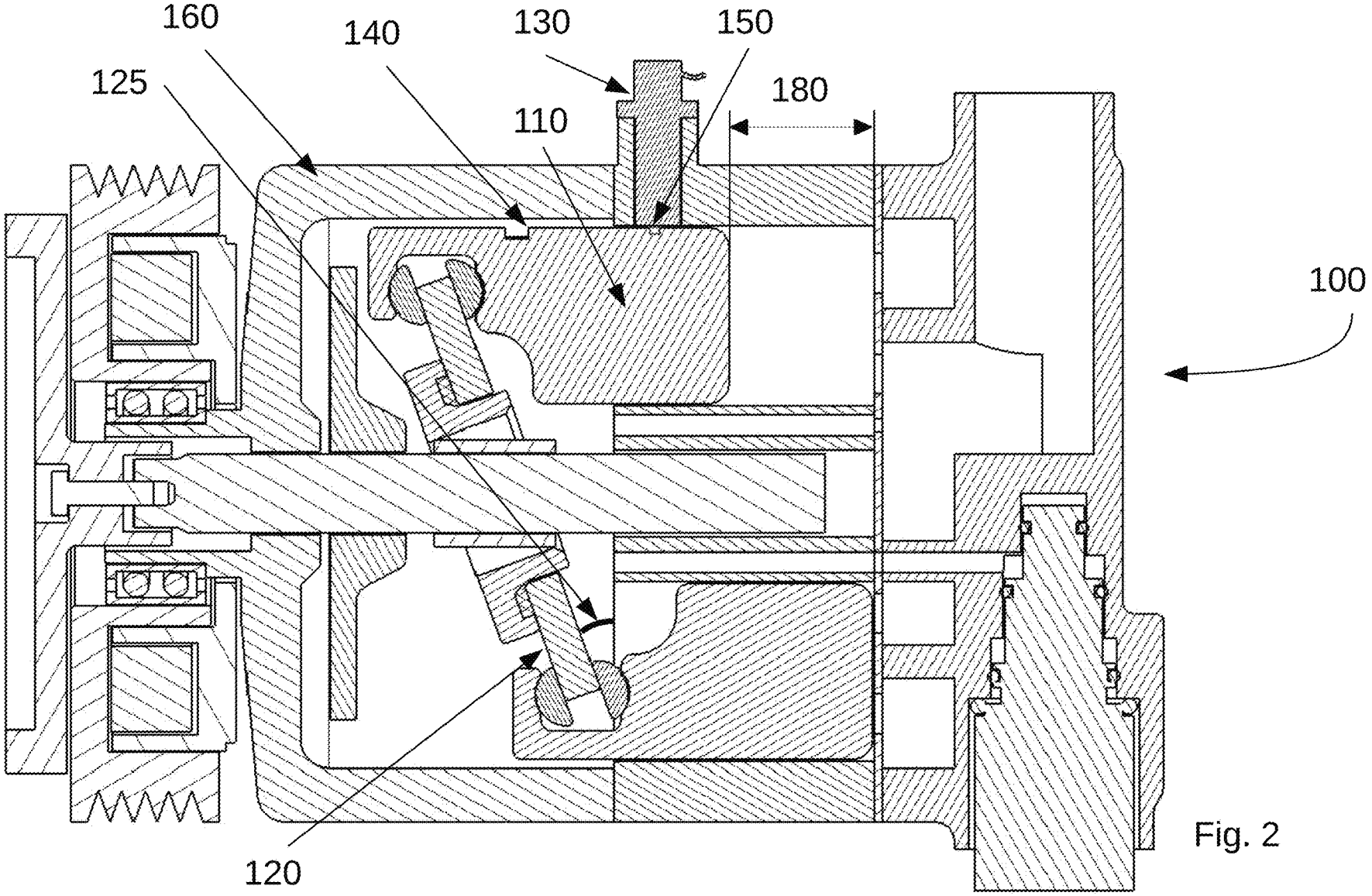
FIG. 2 is a sectional side view of a variable displacement compressor according to one embodiment of the invention in a long stroke length operation.

The variable displacement compressor 100 of FIG. 1 is shown in an increased stroke length operation 180 in FIG. 2. The increased stroke length of the piston 110 is a result of an increased swash plate angle 125.

Figure 3:
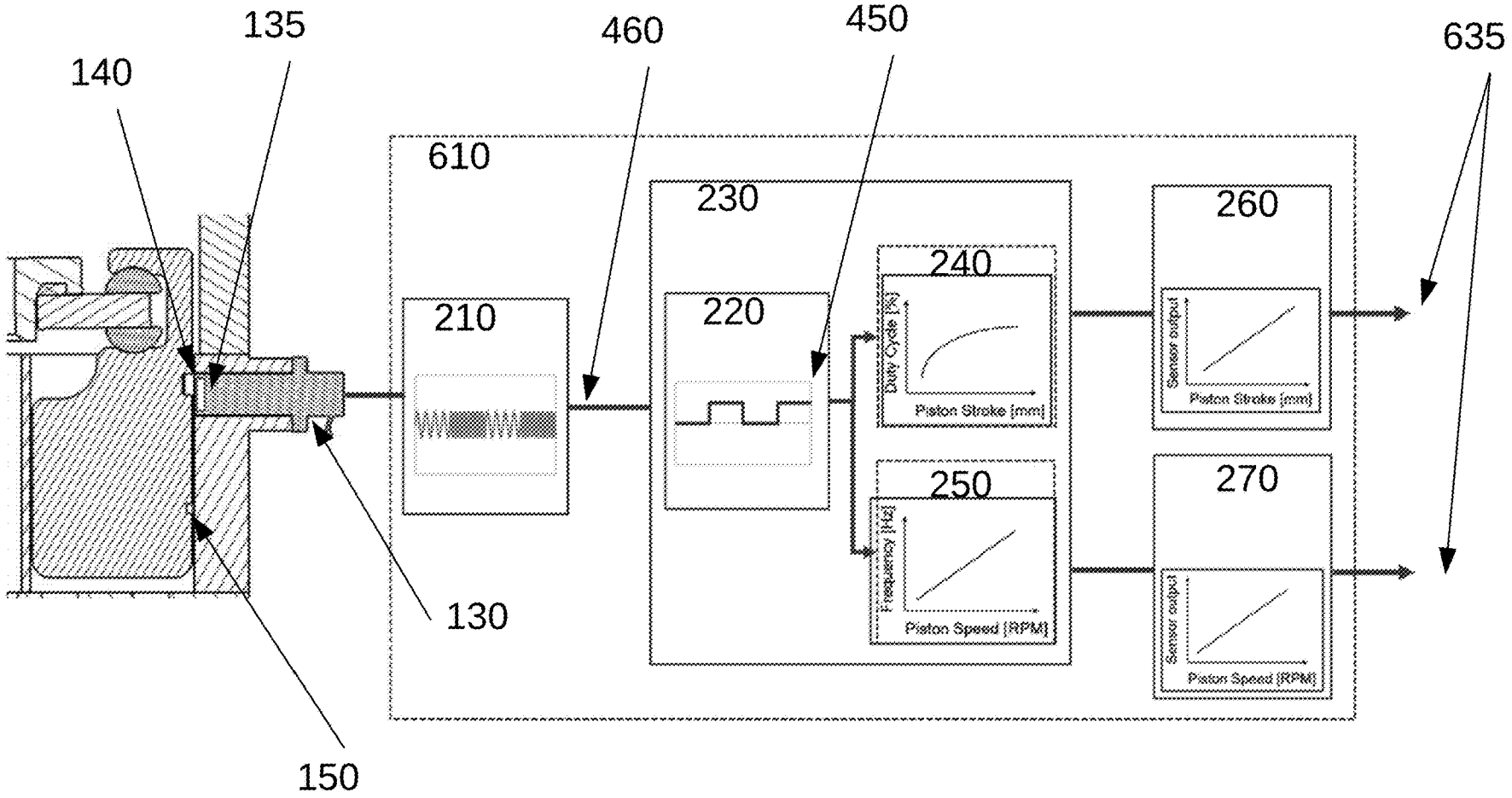
FIG. 3 is a block diagram showing a sensor probe, a processing unit, and signal output.

As shown in an embodiment of FIG. 3, a resonance circuit 210 including the sensor coil 135 generates a signal including the presence and absence of a target 140 (and optionally a calibration target 150). The indication may be by a frequency change in the signal depending on if the target 140 is present or absent. An FM demodulation 220 located in a demodulation circuit 230 may demodulate the resonance signal to generate a signal indicating the presence and absence of the target 140. From the absence and presence of the target 140, a piston stroke length 240 and piston speed 250 may be calculated as described herein. The piston stroke length 240 may be succeeded by a linearization of piston stroke length 260. The piston speed 250 may be succeeded by a linearization of piston speed 270 prior to calculating a piston stroke length and a piston speed. The speed and stroke sensor output signal 635 is, in various embodiments, a PWM, SENT, LIN, PSI5 or CAN output.

In an embodiment, the target 140 is indicated by a change of current carrying capacity and/or change of a piston 110 topography in the target location and the change of current carrying capacity may be the result of the change of topography. The change of topography may be one or more of an air gap in the piston 110, a recess in the piston 110, a groove on the piston 110, a slope or edge of the piston 110, or a hole in or of the piston 110. The change of current carrying capacity may be a result of a specific material in a target 140 area of the piston 110. The specific material may be copper, aluminum and/or hard potting or any other suitable material.

In one embodiment, the target area 140 has a convex topography, is bow shaped, and/or is designed in an arched manner and/or the topography of the target area compensates for axial rotation movement of the piston 110, and/or an air gap between the sensor probe 130 and the target 140 is substantially independent of some piston axial rotation, such as small piston axial rotation, such as piston axial rotation within ±3° of an un-rotated and/or initial piston position. The rotation may be a slight initial rotational misplacement of the piston, rotation variations during operation, and/or an axial rotational drift over time or any other axial rotation movement of the piston. Any piston 110 topology can be used that results in an air gap and/or material thickness and/or material variety change between sensor probe 130 and piston 110 while the piston 110 is moving to indicate the presence and absence of a target 140.

It is also possible to use the piston 110 without modification. For example, the slope near the edge of the piston 110 can be used, or the edge itself or other piston 110 geometry. The end of the piston skirt and/or the bottom of the piston 110 may be used as target 140. The sensor probe 130 position might have to be adapted in this case. The sensor probe 130 is located so that it is over or close to the target 140 in a top dead center piston position, and not over the target 140 in a bottom dead center piston position.

The sensor probe 130 may comprise two coils, one transmitting coil, and a receiving coil. The resonance circuit 210 may in this case comprise both a transmitting and a receiving circuit. The signal received by the receiving coil is processed in this case, for example, by comparing the phase shift between the transmitted and received signal. In one embodiment, the sensor probe 130 comprises one or more sensor coils, such as at least one flat wound coil on a bobbin and/or at least one flat coil on a PCB in one or more layers. In one embodiment, the sensor coil has a transmitting coil and a receiving coil that are either wounded coils or preferably PCBs coils on different layers and the sensor signal is induced in the receiving coil and either a voltage, current, frequency, or phase shift is processed in order to create the processed signal.

Figure 4:
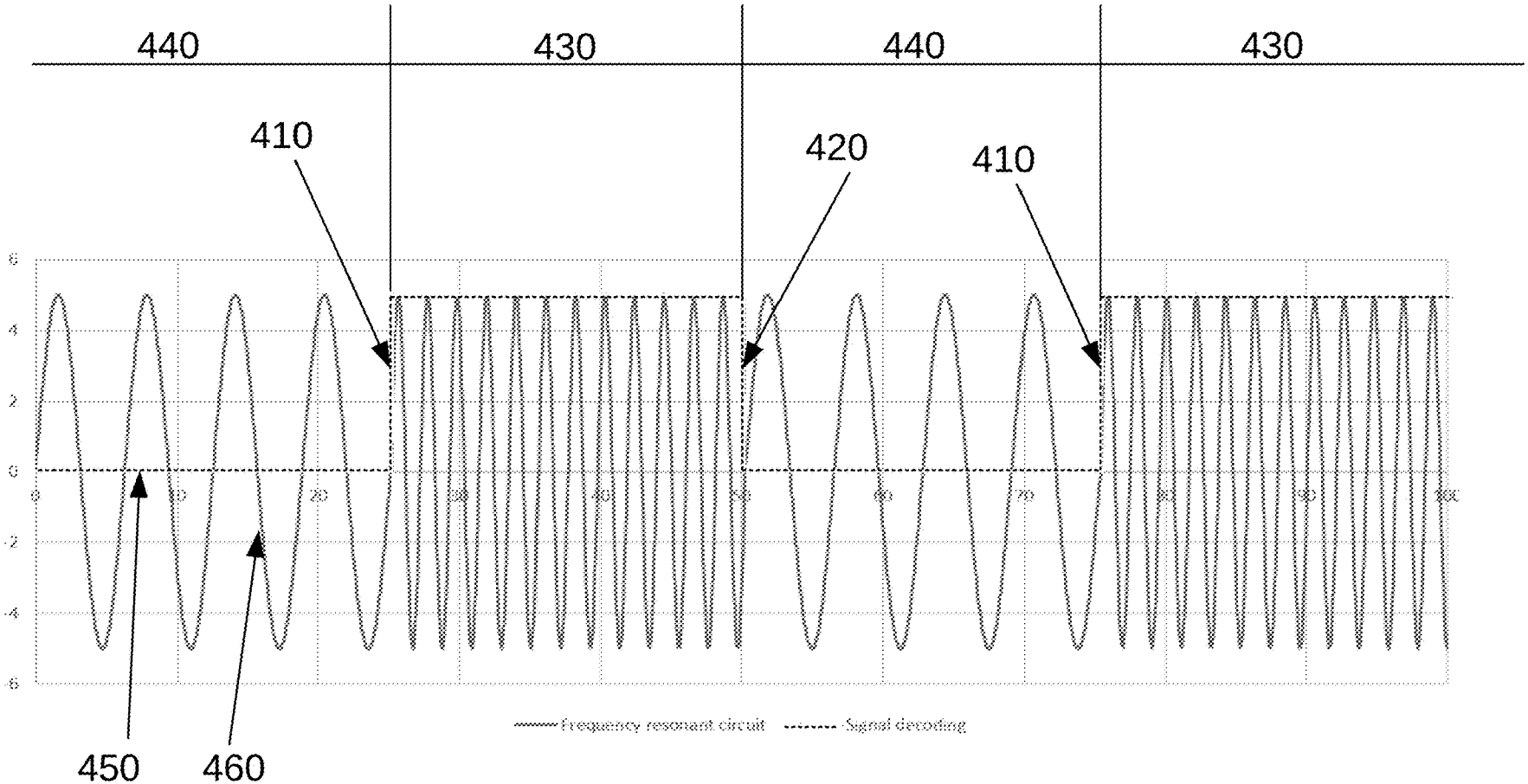
FIG. 4 shows schematically a signal allowing the absence and the presence of a target to be extracted from a frequency demodulation of a resonance signal.

A demodulated signal 450 and a resonance signal 460 are shown in FIGS. 3 and 4. The demodulated signal 450 may be used to indicate the presence and the absence of the target 140. The signal indicating the presence and absence of the target 140 may be directly measured, such as by measuring the impedance of the sensor coil or the current, or voltage or frequency value of the signal, or may be derived/generated from a demodulation of a resonance frequency in a resonant circuit, or by measuring a phase shift between a transmitted signal and a received signal that is influenced/affected by the induced eddy currents.

Where the sensor is an eddy current sensor, the demodulated signal 450 may be generated from an FM demodulation of a frequency, such as a frequency of the resonance signal 460, where the frequency of the resonance signal 460 may be sensitive to an impedance change of an eddy current sensor coil 135 resulting from an absence or a presence of the target 140. The first signal 450 may also be generated by other means, such as by decoding signals from the sensor probe 130. The impedance change may also be the result of a variation of an air gap between the sensor probe 130 and the piston 110.

The increased frequency shown in section 430 of FIG. 4 may be the result of reduced inductance in a resonance circuit due to an opposing magnetic field produced by eddy currents in the piston 110. The lower frequency section 440 may be due to increased inductance produced by a target, such as a gap in the piston 110.

For using an eddy current sensor, not only the air gap is important, but also the material thickness, depending on the penetration depth of the electro-magnetic field in the piston material. For example, a thin piston shell can be detected with the current samples, and any sufficient material thickness change can be used as trigger for target 140. The electrical conductivity of the piston 110 may also be changed locally in order to reduce the eddy current intensity or to prevent the eddy currents from flowing. Adding a groove or changing the thickness of the piston 110 changes the current carrying capacity and may be used as a target 140 and indicated by an eddy current sensor. Using a groove as a local eddy current obstruction results in significant sensitivity of the sensor probe, but also weakens the mechanical stability of the piston 110.

The groove may be filled with a material of less or higher electrical conductivity compared to the non-target part of the piston 110. Where the piston 110 is made of aluminum, the target 140 may be copper or "hard" potting. Any combination of material or different current carrying capacity may be used.

In order to prevent the eddy currents from flowing, small grooves or holes may be formed in the piston 110, such as by machine defined small grooves or drilling small holes into the target area of the piston 110. By machining lines or drilling small holes in the piston 110, the mechanical strength of piston 110 significantly improved compared to piston with one large groove. Any modification on the piston target area can be used, that changes the eddy current intensity compared to the rest of the piston 110.

The sensor may also be a Hall effect sensor. A Hall effect sensor may be biased with a magnet, or the target 140 may be ferromagnetic in order to determine the presence and the absence of the target 140 from the sensor probe 130.

Figure 5:
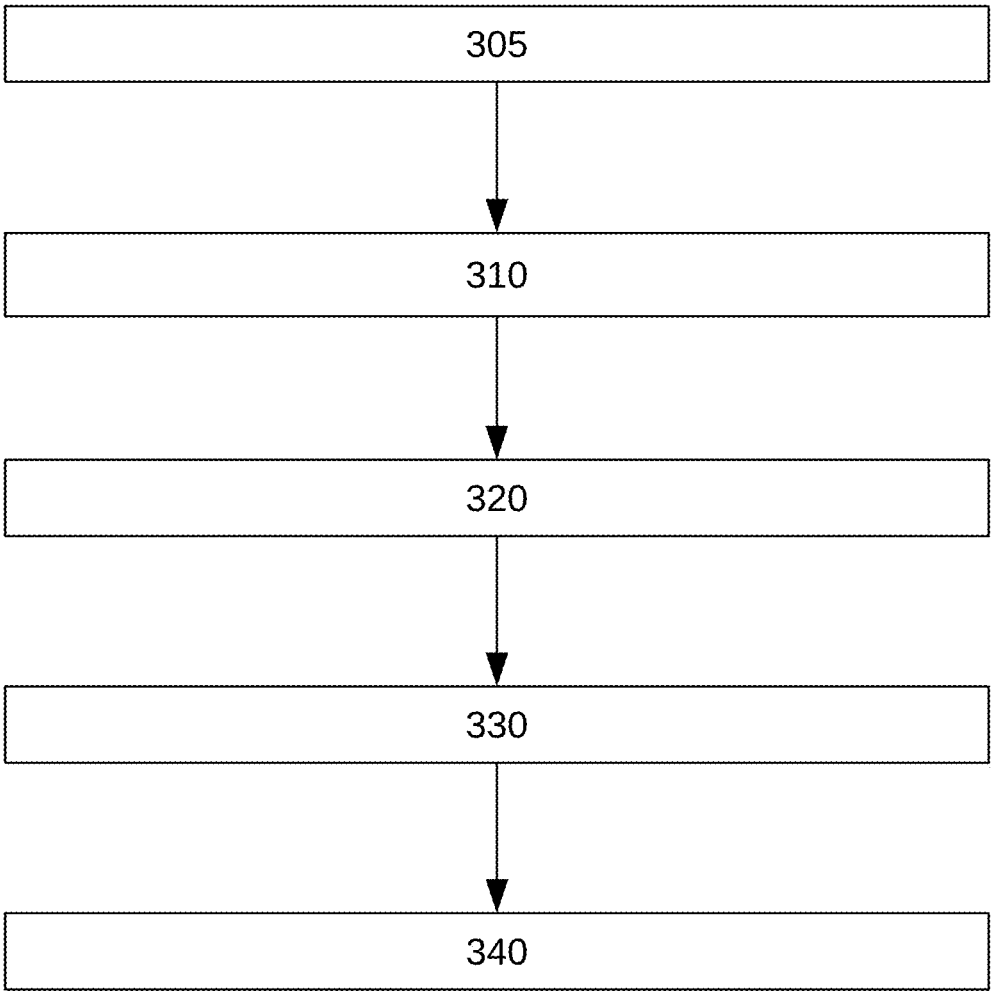
FIG. 5 is a flowchart of a method for generating a signal according to one embodiment of the invention.

FIG. 5 shows steps for generating a signal indicating a stroke speed and a stroke length of a piston. The processing unit supplies the resonant frequency circuit 210 and receives the resonant frequency signal 460 from the resonant circuit 210. In optional step 305, the resonant frequency signal 460 may be demodulated to demodulated signal 450.

In step 310, shown in FIG. 5, the demodulated signal 450 indicates a presence 440 and/or an absence 430 of the target 140 as the target 140 moves relative to the sensor probe 130. The timestamps are extracted when the edge of the target 140 moves past the sensor probe 130, and both piston speed, and piston stroke length can be derived. The sensor probe 130 allows first timestamps (such as raising edges) 410, shown in FIG. 4, to be measured at times when the target 140 moves from being present 440 at the sensor probe 130 to being absent 430 from the sensor probe 130. The sensor probe 130 allows second timestamps 420 (such as falling edges), shown in FIG. 4, to be measured at second times when the target 140 moves from being absent 430 from the sensor probe 130 to being present 440 at the sensor probe 130.

The steps, as shown in FIG. 5, further include a step of determining 320 a periodicity of the piston 110 by applying a first function to at least two timestamps of the first timestamps 410 or at least two timestamps of the second timestamps 420. The periodicity may also be derived from measuring every n-th timestamps of the first and/or the second timestamps, such as every third timestamp. The time difference is then suitably divided by the number of interval number to arrive at the periodicity during the measured time interval. The periodicity is expressed in time units, but may also be expressed in one over time unit (frequency) with corresponding amendments of computations. In this way, the periodicity (i.e. the piston/swash plate/compressor reciprocation/revolution time) may be calculated from the time difference between a first rising edge and a second raising edge or a first falling edge and a second falling edge of the signal indicating the presence and absence of the target.

The steps further include determining 330 a target duty cycle ratio by comparing a target pulse duration generated from at least one timestamp of the first timestamps 410 and at least one timestamp of the second timestamps 420 with the periodicity. The target duty cycle ratio may be derived by dividing a target pulse duration with the periodicity, the target pulse duration typically derived by measuring the time between one or more timestamps of the first timestamps and one or more timestamps of the second timestamps (time between "rising" to "falling" or time between "falling" to "raising"). By dividing the pulse duration with the periodicity, a stroke speed independent target duty cycle ratio can be derived.

The target duty cycle ratio corresponds to the amount of time where the target 140 is present at the sensor probe 130 over to the time of a full piston stroke. Since the time where the target 140 is present at the sensor probe 130 added to the time where the target 140 is absent at the sensor probe 130 equals the time of a full stroke, the target duty cycle ratio may also be defined as the time where the target 140 is not present at the sensor probe 130 over to the time of a full piston stroke, with the corresponding adjustments to calculations.

The steps further include generating 340 the signal indicating the stroke speed and the stroke length from the periodicity and the target duty cycle ratio. The first timestamps may correspond to raising edges of the signal and the second timestamps may correspond to falling edges (flanks) of the signal. The first timestamp may also correspond to falling edges (flanks) of the signal and the second timestamps may correspond to raising edges of the signal.

The piston stroke length may be indicated as target duty cycle ratio or may be derived from the target duty cycle ratio by transformation of duty cycle ratio to stroke length. The piston stroke length may be adjusted for piston movements that are not sinusoidal (for all stroke lengths, or for some stroke lengths, such as for longer stroke lengths). The piston stroke length may also be adjusted for a specific swash plate piston connection design and hysteresis in piston movements.

Figure 6:
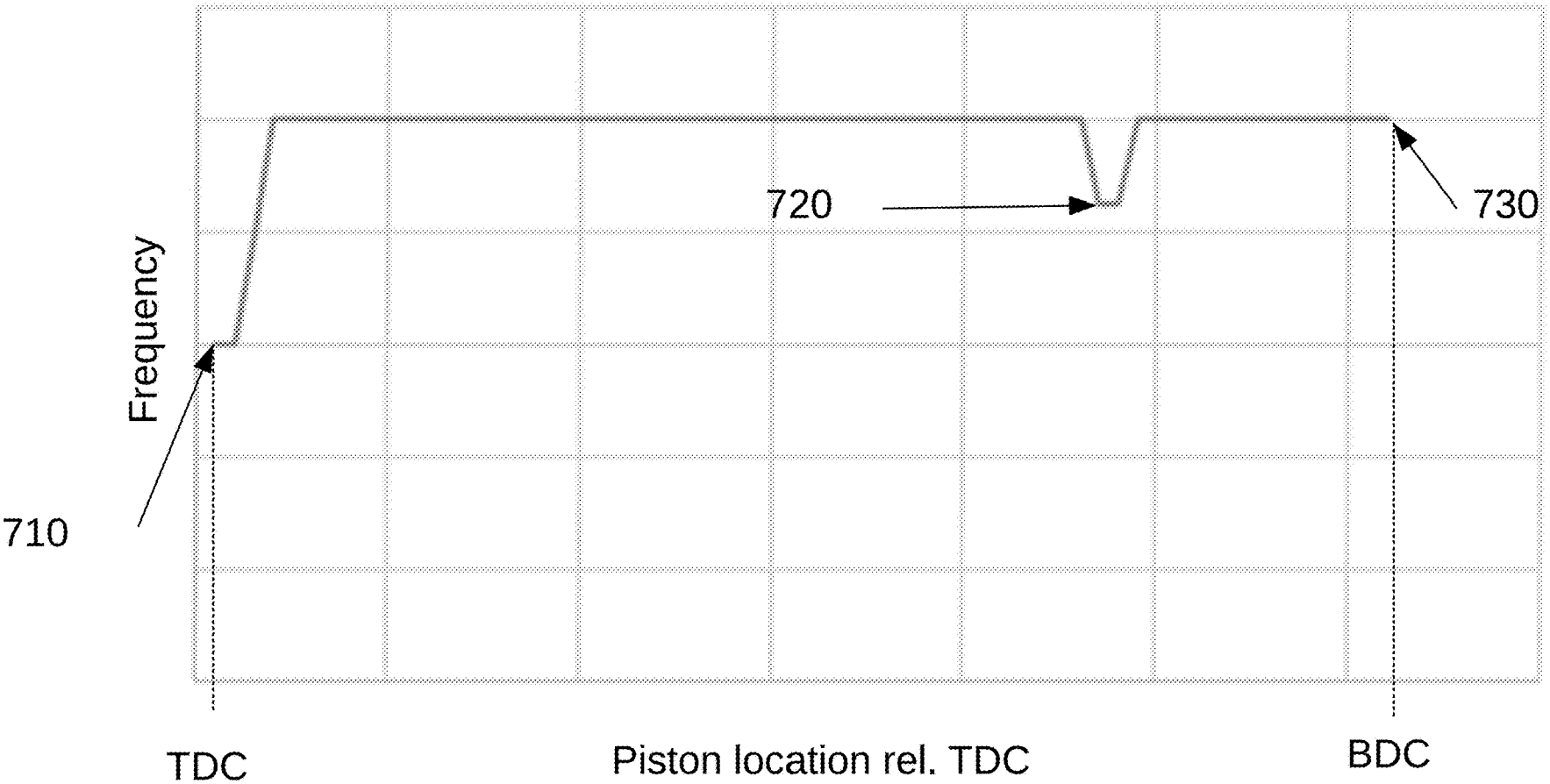
FIG. 6 is a graph of a resonance frequency signal as a function of a piston distance from a top dead center (TDC)

FIG. 6 shows the resonance frequency in the resonance circuit at different piston locations relative to top dead center (TDC) 710 in a maximum stroke length operation. Close to TDC, the resonance frequency is lower indicating presence of the target 140. Above the TDC, the resonance frequency increases indicating the absence of the target 140. At a certain distance from TDC, the resonant frequency drops again at 720 indicating the presence of the calibration target 150. As the piston (and the calibration target) moves past the sensor probe, the resonant frequency increases again, indicating the absence of the calibration (and main) target. The piston reaches finally bottom dead center (BDC) 730 (which is the maximum stroke length for this configuration).

Figure 7:
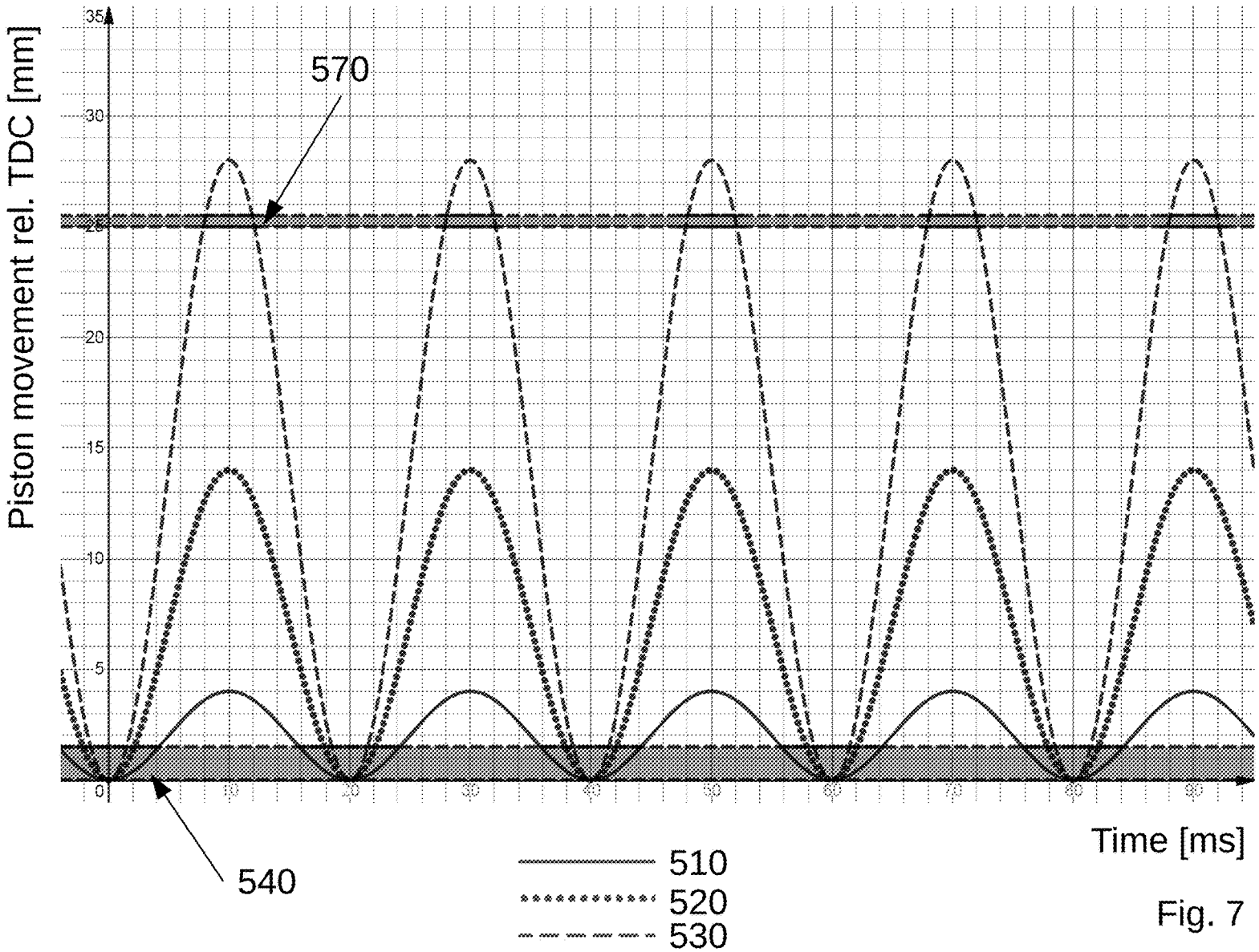
FIG. 7 is a graph depicting piston movement in three different stroke length operation.

FIG. 7 depicts a graph showing location of a piston from a top dead center (TDC) as a function of time running at 3000 RPM. Solid line 510 shows a piston location as a function of time at low piston stroke length (ca 4 mm stroke length). Dotted line 520 shows piston location as a function of time at medium stroke length (ca 14 mm stroke length). Dashed line 530 shows piston location as a function of time at high stroke length (ca 28 mm stroke length). For all the shown stroke lengths, the piston speed (and so the compressor speed) is the same. Reference numeral 540 shows the locations of the piston where a sensor signal 450 indicates a presence 440 of a target. As can be seen from the graph, in this example, the sensor probe indicates the presence 440 of a target when the piston is located near the piston top dead center. The sensor probe indicates the absence of the target when the piston is near the bottom dead center. As can be seen from the graph, time during which the sensor signal indicates a presence 440 of a target decreases (and so the target duty cycle ratio) as the stroke length increases. By measuring the decrease in target duty cycle ratio, the stroke length of the target may be calculated with high accuracy and low latency as described herein.

FIG. 7 also depicts locations 570 of the piston when the sensor probe indicates the presence of a calibration target 150. The location of piston when the sensor probe indicates the presence of a calibration target may be near the bottom dead center (BDC) of the piston. The calibration target may be located at any suitable location, such as, but not limited to, within ⅓ from the piston bottom dead center at maximum stroke length. The location of piston when the sensor probe indicates the presence of a calibration target may also determine a calibration duty cycle ratio and further used to improve the accuracy of the calculation of piston stroke lengths as described herein.

Figure 8:
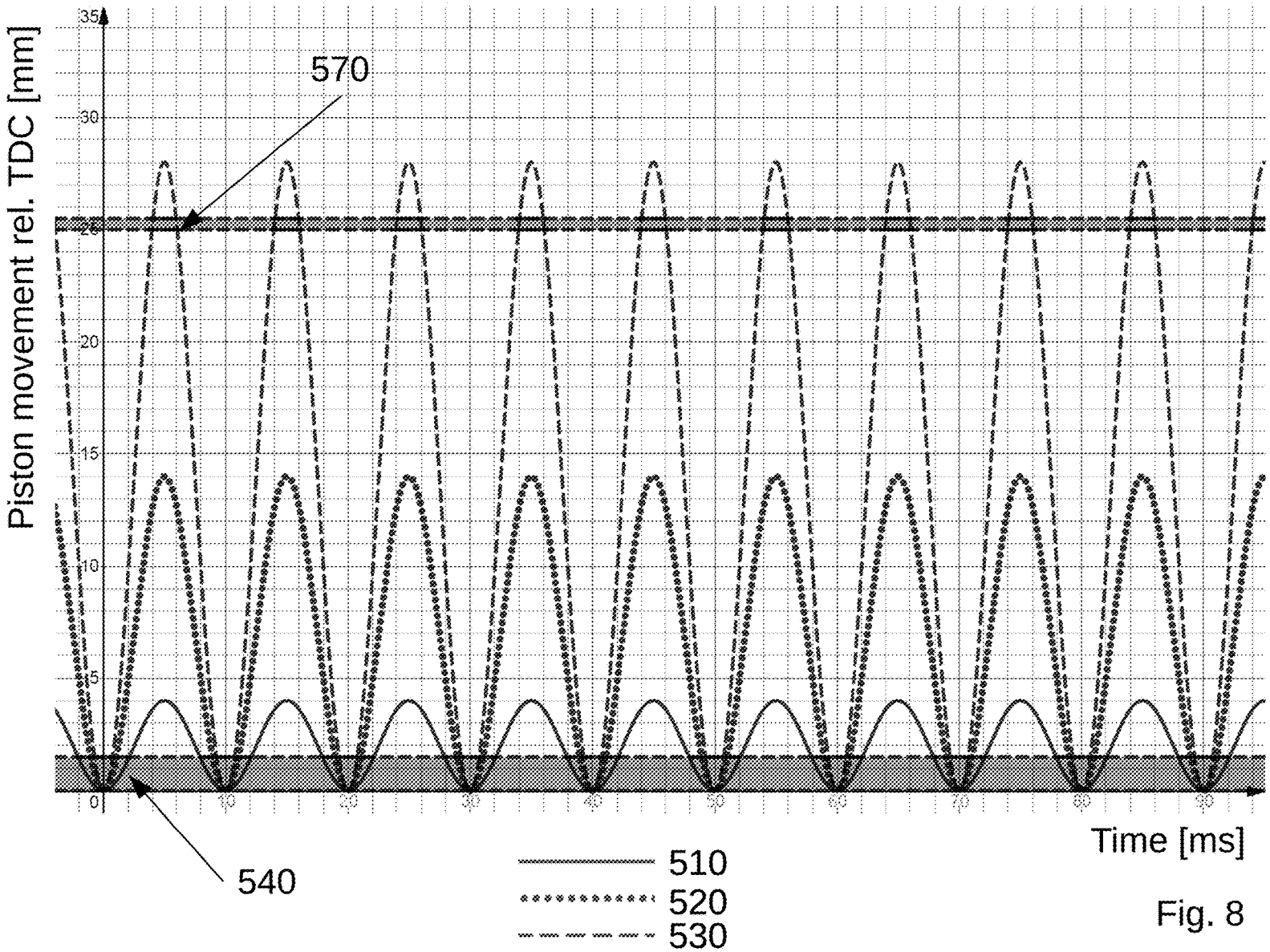
FIG. 8 is the graph of FIG. 7 with increased piston speed.

FIG. 8 shows a graph showing location of a piston from the top dead center as a function of time running at 6000 RPM. As shown in FIG. 8, the duty cycle ratio and the corresponding calculation of the piston stroke length is unaffected by the change in compressor speed.

The piston location as a function of time is depicted as substantially sinusoidal in FIGS. 7 and 8. The actual location of the piston may not be approximately sinusoidal as long as the duty cycle ratio of the target time can be mapped to stroke length. The mapping may be analytically and/or experimentally. The mapping may also be analytical with correction factors derived experimentally. In one embodiment, the stroke length is derived from the target duty cycle ratio using a map that translates and/or linearizes from target duty cycle ratio to stroke length. The map includes one or more functional relationships, such as a relationship including one or more polynomial function, one or more trigonometric functions, or one or more look-up tables. The functional relationship may be stored in one or more look-up tables. The piston stroke length may be derived by interpolation between target duty cycle ratio values (such as two or more consecutive target duty cycle ratio values) in order to calculate a corresponding piston stroke length. The target duty cycle ratio values may be retrieved from a look-up table. The interpolation may be of an order (such as an n-order), such as a first order, preferably second order, or more preferably third order.

Figure 9:
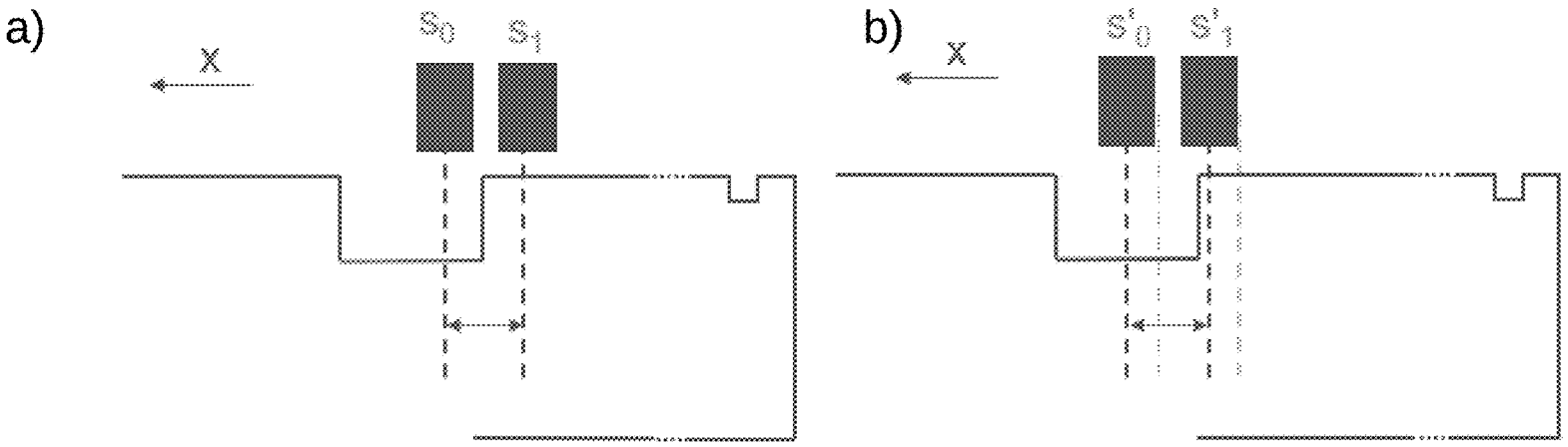
FIG. 9 is a schematic diagram of an ideal position and a position of a sensor coil shifted due to tolerance.

FIG. 9 shows an ideal position S0, S1 (case a) and a shifted sensor position S0', S1' (case b). The sensor position may be shifted due to tolerance. Tolerances in piston movement direction (x-direction) between the target groove and the sensor location affects the accuracy of the calculation of stroke length from duty cycle ratio. Tolerances can be caused by manufacturing of sensor parts, assembly of sensor, assembly of sensor to compressor, position tolerances of compressor mounting hole, etc.

Case a) shows an example where the piston moves from s0 to s1, i.e. a minimum stroke length in this configuration of for example 0.7 mm. Case a) depicts an ideal position. In this case, the resulting duty cycle ratio is about 50%.

In case b) the position of center of sensor coil in relation to the main groove has shifted due to tolerances. This results to a resulting duty cycle ratio that is much lower, about 20% in the example. If the incorrect (shifted) duty cycle ratio of 20% is used to calculate the stroke length, an incorrect stroke length would be the result.

A calibration routine is therefore described that can be applied without any costly reference piston stroke sensor, i.e. by using a second target on the piston, a calibration target. The target may be a second groove, such as an oil groove already located on the piston without any further need of piston modification.

Figure 10:
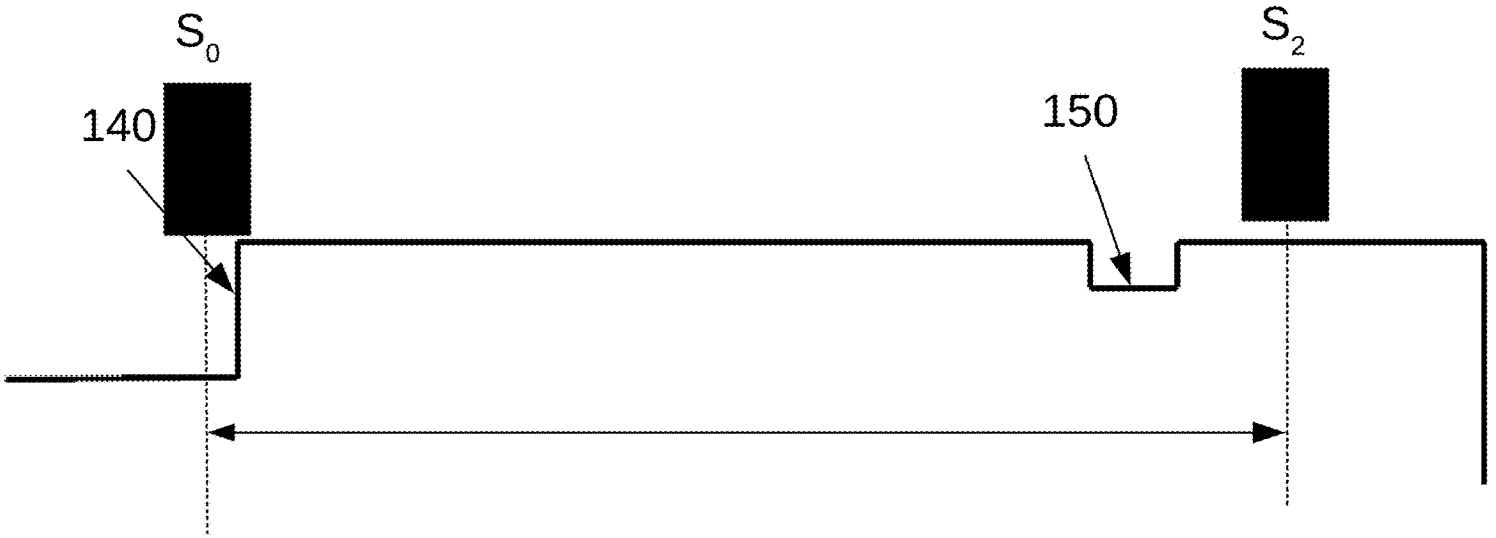
FIG. 10 is a schematic diagram of a minimum stroke length for the sensor probe to detect the calibration target.

FIG. 10 shows a minimum stroke length for the sensor probe to detect the calibration target. The piston stroke needs to be large enough to enable the sensor probe to detect the first edge of the calibration groove 150, e.g. travelling from top dead center S0 to calibration target detection S2. As shown in FIG. 10, the calibration can be done at any time when the piston stroke is large enough for the sensor probe to indicate the calibration target. Suitable times for performing the calibration may include, during the compressor end-of-line test or during the vehicle end-of-line test. The calibration may also be performed during vehicle operation, such as with certain intervals, or at vehicle or compressor start-up.

Figure 11:
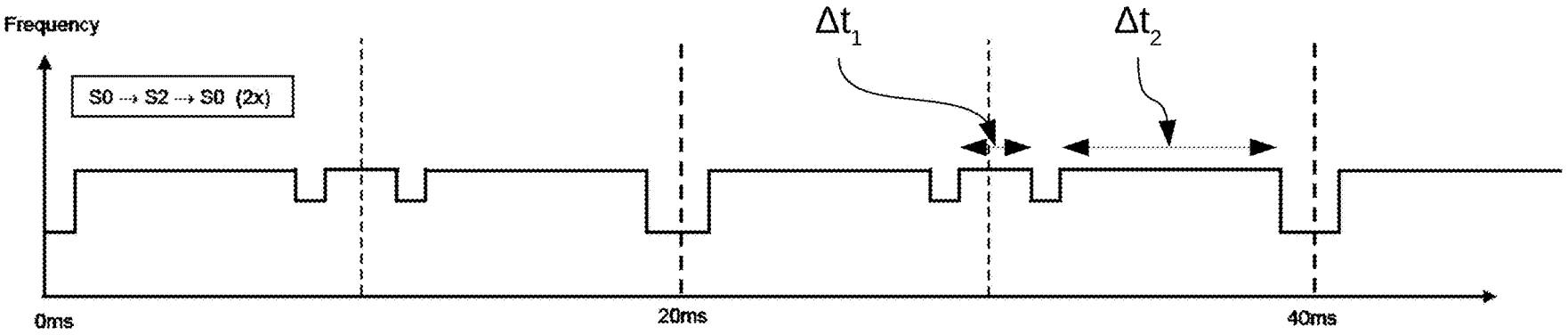
FIG. 11 is a graph of a resonant frequency as a function of time during two revolutions of the swashplate at 3000 RPM.

FIG. 11 shows resonant frequency as a function of time during two revolutions of the swashplate rotating at 3000 RPM. FIG. 11 also shows the time between two calibration frequency drops (Δt1) and time between a main target frequency drop and a calibration frequency drop (Δt2). If for example, it is known that calibration is performed at maximum stroke length, this information can be used to distinguish the drop indicating the calibration target from the main target. The signal will indicate four drops per rotation. Since it is known that time between two calibration frequency drops (Δt1) is shorter than time between a main target frequency drop and a calibration frequency drop (Δt2), this can be used to distinguish the main target drop from the calibration target drop. The identification of the main target drop from the calibration drop can also be done e.g. by identifying that the groove depth of the calibration groove (and so the frequency drop) is smaller than the depth of the sensor groove. The frequency drop may be the result of a different shape or material of the calibration target. The difference in frequency drop is detectable to identify if the frequency drop is from the main target or from the calibration target.

Figure 12:
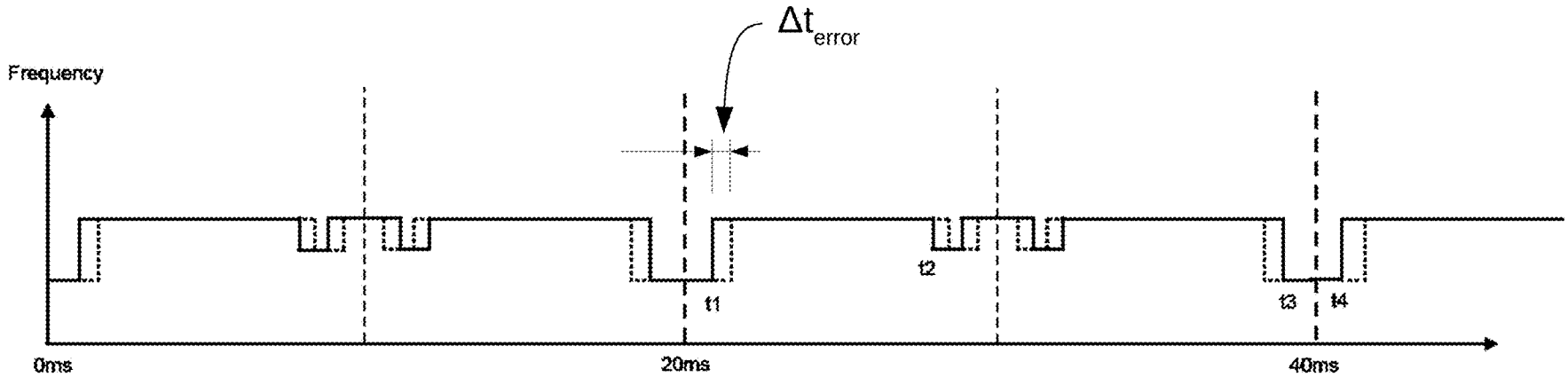
FIG. 12 is a graph with a same configuration as FIG. 11 where tolerance has introduced an error in the form of a time shift.

FIG. 12 shows the same configuration as FIG. 11 where tolerance has introduced an error in the form of a time shift (Δterror) as described under FIG. 9 in relation to case b). The described case b) in FIG. 9 results in the correct frequency signal (solid line, FIG. 12) being modified to a tolerance affected frequency signal (dotted line) and results in an incorrect target duty cycle ratio being calculated. The stroke reciprocation time (T=t4−t1) does not change, but the pulsewidth time (ON time) decreases (t3−t1) leading to an incorrect duty cycle ratio and therefore an incorrect stroke length calculation.

The tolerance affected target duty cycle ratio may be calculated as follows:

$$DC_{target} = \frac{\text{On_Time}}{\text{Period}} = \frac{(t3 - \Delta t_{error}) - (t1 + \Delta t_{error})}{(t4 + \Delta t_{error}) - (t1 + \Delta terror)} = \frac{t3 - t1 - 2 * \Delta t_{error}}{t4 - t1}$$

By using signals indicating the calibration target, the incorrect duty cycle ratio can be corrected. The processing unit may be configured to calibrate the stroke length generated from the target duty cycle ratio using the signal indicating the presence of the calibration target. The calibration may include applying a calibration factor to the map that translates from target duty cycle ratio to stroke length.

The signal indicating the calibration target may be used to calculate a calibration duty cycle ratio. The calibration duty cycle ratio may be independent of axial tolerances (the time difference between the rising edge of the sensor groove (t1) and the falling edge of the calibration groove (t2) is independent from axial tolerances). The calibration duty cycle ratio may be defined:

$$DC_{Calibration} = \frac{(t2 + \Delta t_{error}) - (t1 + \Delta terror)}{(t4 + \Delta terror) - (t1 + \Delta terror)} = \frac{t2 - t1}{t4 - t1}$$

As is seen in the equation, the time shift of the signals cancel out each other, and the calibration duty cycle ratio is independent of tolerances in piston movement direction. Like the target duty cycle ratio, the calibration duty cycle ratio is also independent of the compressor RPM.

In one embodiment, the step of calibrating the generated stroke length includes correcting the target duty cycle ratio with a correcting factor of a correction function, the correcting factor or function derived from the current calibration duty cycle ratio and the current target duty cycle ratio, and a pre-stored accurate correlation between calibration duty cycle ratio and target duty cycle ratio. The correcting factor may be applied to the map translating from target duty cycle ratio to stroke length.

In one embodiment, the step of calibrating the generated stroke length is performed when the piston stroke length is above a minimum stroke length required for the sensor probe to indicate the presence of the calibration target, such as during compressor and/or vehicle end-of-line test or during normal operations, such as with a certain time interval, at vehicle start-up, or continuous when the stroke length is above a minimum calibration stroke length.

In one embodiment, the minimum stroke length required for the sensor probe to indicate the presence of the calibration target may be ⅔ of the maximum stroke length depending on the position of the sensor probe and the calibration target.

In one embodiment, the calibration target is indicated by a change of current carrying capacity and/or change by a piston topography in the target location and the change of current carrying capacity may be the result of the change of topography. The change of topography may include: an air gap in the piston, a recess in the piston, a hole in or of the piston, a groove on the piston, a slope or edge of the piston. An oil groove located on the piston skirt may be used as calibration target. The improvement allows an eddy current sensor to be used to indicate the presence and absence of the target. By using the oil groove as a calibration target, no further adjustments are made to the piston, thereby avoiding any further piston machining.

In one embodiment, the signal indicating the presence of the calibration target is distinguishable from the signal presence of the main target although the same sensor probe is used. The signals may be distinguishable using uncalibrated piston stroke information, such as piston speed and/or piston stroke length and/or difference in calibration and target presence duration.

That is, if the maximum possible error of an uncalibrated sensor is known, the different grooves can be identified by their position on the piston by the uncalibrated default piston stroke information. For example, if the maximum error is e.g. ±5 mm, a frequency change at a piston position above e.g. 15 mm must belong to a calibration target. The distinction may also be based on a difference in time between two calibration target frequency changes (drops) compared to a time difference between a main target frequency drop and a calibration frequency drop. The difference may also be based on a difference in frequency change (drop) between the target and the calibration target. The difference may be due to a difference in topography and/or material leading to a different induced eddy current as the target and the calibration target moves relative to the sensor probe. The differentiation between the main groove and the calibration groove ensures that the normal operation mode is not influenced by the calibration groove.

In one embodiment, the step generating the signal indicating the stroke speed and the stroke length includes a linearization of the target duty cycle ratio. In order to improve the linearization accuracy, the target duty cycle ratio may be given by the equation:

$$DC_{rel} = \frac{\text{On_time}}{\text{Off_time}} = \frac{1}{\frac{\text{Period}}{\text{On_time}} - 1}$$

The equation may correspond to a comparison between detection of pulse width ON time (420 till 410) and the pulse width OFF time (410 till 420) where pulse width ON_time is a time duration where the sensor probe (130) is indicating the presence of the target, and the OFF_time is a time duration where the sensor probe (130) is indicating the absence of the target and Period is the total ON_time and OFF_time period. The equation allows better linearity and therefore better fit function adoption.

The correct target duty cycle ratio for one or more given calibration duty cycle ratio is predetermined. The relationship can be stored as an algorithm or a look-up table and be calculated from piston geometry or measured with a reference stroke sensor, automatically stored and may be used for all compressors of the same type. Using one or more known correlations between calibration duty cycle ratio and target duty cycle ratio, one or more point calibrations can be performed.

In an exemplary embodiment, from a (one-time) reference measurement it is known that a calibration duty cycle ratio of 75% corresponds to 26 mm piston stroke length and that at this stroke, the target duty cycle ratio should be 70%. But, due to axial tolerances, the measured target duty cycle ratio is only 68%, meaning a 2% error. Using this knowledge, a one-point calibration can be done by applying a correcting factor to the target duty cycle ratio (such as calibrating the complete look-up-table and/or map) in order to adjust the calculations to the correct output value of 70%. The one point calibration can alternatively be done after linearization of the sensor output.

Figure 13:
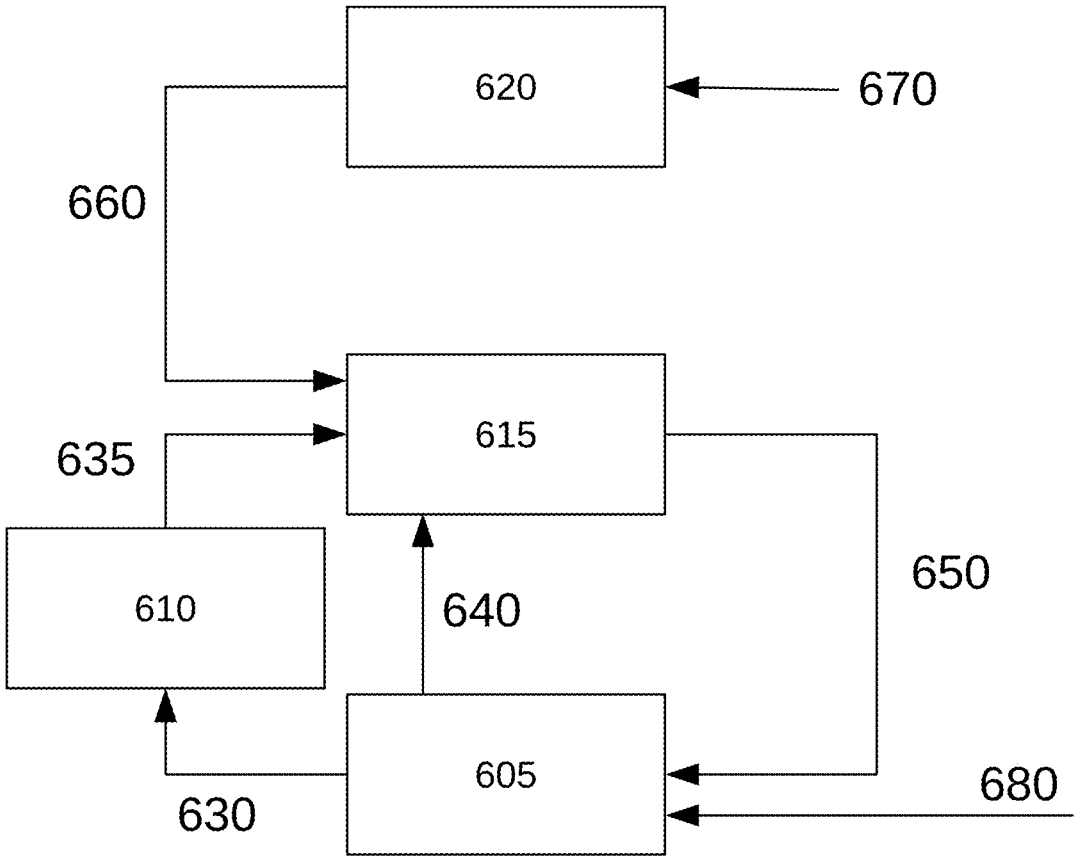
FIG. 13 is a block diagram of an exemplary system for controlling the temperature in a car according to one embodiment of the invention.

FIG. 13 depicts a system for regulating a cooling (or heating) capacity of a variable displacement compressor. The system may comprise a compressor 605, a signal processing unit 610, a compressor controller 615, and a Heating, Ventilation, and air conditioning unit (HVAC unit) 620. The system may further include a sensor signal 630, a speed and stroke signal 635, additional sensor signals 640 like the pressure in the suction part of the compressor or the pressure in the crank case of the compressor, a swash plate angle adjustment signal 650, a compressor control signal 660, and a HVAC input signal 670. The compressor 605 may be driven by compressor rotor angular velocity 680.

The compressor controller 615, as shown in FIG. 13, may receive a compressor control signal 660 with a requested compressor performance (such as a requested piston stroke length, a requested swash plate angle, a requested refrigerant mass flow, a requested suction pressure and/or a requested evaporator outlet air temperature, and/or a requested compressor torque). In order to efficiently and accurately achieve the requested compressor performance, the controller 615 reads speed and stroke signal 635 from signal processing unit 610, in which the piston stroke length and speed is calculated or derived based on sensor signal 630 with high accuracy and low latency as described above. Using the speed and stroke signal 635, the compressor controller 615 may affect the swash plate angle adjustment signal 650 to increase or decrease the swash plate angle to reach the requested compressor performance.

Where the external control signal 670 indicates desired piston stroke length, the swash plate angle adjustment signal 650 is affected until the read piston stroke length corresponds to the requested piston stroke length. Where the external control signal 670 indicates desired swash plate angle, the desired swash plate angle may be converted to corresponding piston stroke length (or piston stroke length signal is converted to swash plate angle) before the actual and desired values are compared.

Where the external control signal 670 indicates suction pressure or evaporator outlet air temperature, the compressor controller 615 may use additional sensor signals 640 shown in FIG. 13 to generate appropriate swash plate angle adjustment signal 650. The compressor controller 615 may read additional sensor signals 640, such as including compressor and/or refrigeration cycle suction pressure and crankcase pressure, and compressor speed.

Where the external control signal 670 indicates a desired compressor mass flow rate, the adjustments to the current compressor mass flow rate may be calculated from the piston speed, the piston stroke length, and/or additional sensor signals 640 such as suction and/or evaporator pressure signals.

The HVAC unit 620 may receive a HVAC input signal 670 (such as indicating current suction pressure, evaporator outlet air temperature, compressor torque, compressor speed, and/or vehicle compartment air temperature) to generate compressor control signal 660 as shown in FIG. 13. The signal values may be directly measured or calculated and/or estimated from signal values. The HVAC may be a separate processing unit (such as a HVAC ECU) or be part of an engine processing unit (such as an engine ECU) or part of other vehicle processor units.

The compressor controller 615 may be located with the HVAC unit 620, be a module of the HVAC unit 620, or be located in any other suitable location. The compressor controller 615 may physically be part of the compressor 605, or separate but operationally connected to the compressor 605.

The signal processing unit 610 may be located on the compressor 605, with the compressor controller 615 (such as integrated in the compressor controller 615), be a module of the compressor controller 615, or be separate but operationally connected to the compressor and/or compressor controller 615 and/or HVAC unit 620. The signal processing unit 610 may be part of the sensor housing (such as integrated in the sensor housing). The processing unit may also be integrated into the HVAC unit 620.

It is an aim of the present invention to improve efficiency, reduce fuel consumption, and reduce exhaust emission in vehicle operations. A further aim of the invention includes improved safety of vehicle air conditioning operation and improve operation reliability of air conditioning compressors. A further objective is to improve the accuracy and reduce the latency of compressor torque calculations. A further aim is to provide additional monitoring capabilities of compressor operations. A further aim is to improve the accuracy and reduce the delay of compressor piston stroke length feedback and an additional, improved feedback of compressor piston reciprocation frequency.

The invention includes faster and significantly more accurate piston movement feedback. The faster and more accurate piston movement feedback improves vehicle efficiency and reduces fuel consumption and exhaust emission by increasing the speed of swash plate angle control, in particular by enabling a new type of compressor control. Swash plate angle and hence piston stroke length is typically controlled by regulating a pressure difference in the compressor. Previous compressor designs include a "bleed hole". The bleed hole results in compressed refrigerant bleeding back from the crank case chamber of the compressor to the suction chamber, increasing energy consumption and temperature. The invention allows the bleed hole to be reduced or closed. Closing or reducing the bleed hole results in more severe requirements for the swash plate control. Without bleed hole it is crucial to react very fast on swash plate movements. The less stable swash plate can be stabilized in a control loop using the signal of the present invention, especially the piston stroke length that can directly be calculated or derived from the signal leading to a more precise control.

The invention further allows to improve the compressor control using the piston speed or the compressor speed, respectively, that can directly be calculated from the sensor signal, in order to react very fast on any compressor speed changes.

The invention further allows the mass flow rate of the compressor to be directly calculated from the direct piston speed and stroke length calculation in addition with signals, such as signals from suction chamber pressure sensors.

The invention may also be used to calculate additional physical values in addition to piston stroke speed and piston stroke length. These may include displacement rate, clearance volumetric efficiency, work of the compressor, coefficient of friction (piston to cylinder), refrigerant mass flow, etc. These calculations may require additional sensor information.

For highest precision of mass flow calculation, values indicating discharge pressure, suction temperature and discharge temperature figures may also be included, in addition to piston speed, piston stroke and suction pressure. With more sensor values input, the accuracy of the mass flow calculation further increases.

A desired mass flow rate of the compressor can hence be achieved by adjusting the swash plate angle until the desired mass flow rate is achieved. It is also possible to derive a faster and more accurate calculation of the actual compressor torque using the current invention. The faster and more accurate actual compressor torque calculation can be fed to engine control unit for more efficient and smoother vehicle operations.

The invention allows the safety of vehicle air conditioning operation and the operation reliability of air conditioning compressors to be improved by allowing additional and direct monitoring of the compressor operations. Appropriate actions (such as indicating a warning signal to the user and/or decreasing compressor load and/or turning off the compressor) can be taken if the speed and/or load of the compressor is overreached. The additional signal of piston stroke speed may be compared with independent signals of engine speed and/or compressor rotor angular velocity to directly monitor compressor failure, such as compressor lock up, compressor or liquid slugging (liquid compression in cylinder bore). A slippage of the belt can be detected with the invention.

The invention also allows to measure precisely the material thickness of e.g. the piston skirt and thus enables the early detection of piston wear which increases the operation reliability of the air conditioning compressor.

The more accurate and faster piston data allows faster feedback to the air conditioning control allowing a more precise air conditioning control, further reducing energy consumption and improving passenger comfort, for examples in case when a high peaking torque is measured. In this case the invention allows the compressor torque to be reduced.

The air gap between the sensor probe 130 and the target 140 is less dependent on (or substantially independent of) some or all piston axial rotation movements which may allow for variations in piston axial rotational without substantially affecting the sensor signal received from the sensor probe. A further advantage of this embodiment may be increased robustness of piston stroke speed and stroke length indications, and/or increased tolerance during parts manufacturing and/or assembly.

What is claimed is:

1. A variable displacement reciprocating piston unit, comprising:

a sensor probe;

a target that is a target area;

a piston having a top dead center position and a bottom dead center position, the sensor probe, the target, and the piston are located in relation to each other so that the target is moved from being absent from the sensor probe to being present at the sensor probe when the piston travels towards the top dead center position, and the target is moved from being present at the sensor probe to being absent from the sensor probe when the piston travels towards the bottom dead center position; and a signal processing unit configured to:

receive a signal from the sensor probe indicating a presence and/or an absence of the target as the target moves relative to the sensor probe, the signal allows a plurality of first timestamps to be measured when the target moves from being present at the sensor probe to being absent from the sensor probe, and the signal allows a plurality of second timestamps to be measured when the target moves from being absent from the sensor probe to being present at the sensor probe;

determine a periodicity of the piston by applying a first function to at least two timestamps of the first timestamps or at least two timestamps of the second timestamps;

determine a target duty cycle ratio by comparing a target pulse duration generated from at least one timestamp of the first timestamps and at least one timestamp of the second timestamps with the periodicity; and generate a signal indicating a stroke speed and a stroke length of the piston from the periodicity and the target duty cycle ratio.

2. The variable displacement reciprocating piston unit of claim 1, wherein:

the target is indicated by a change of current carrying capacity and/or a change of a piston topography in a location of the target;

the change of the piston topography is one or more of: an air gap in the piston, a recess in the piston, a groove on the piston, a slope or edge of the piston, or a hole in or of the piston;

the change of current carrying capacity is a result of a target material with an electrical conductivity different from a material of the piston, the target material is a copper or a hard potting; and/or the change of current carrying capacity is a result of the change of the piston topography.

3. The variable displacement reciprocating piston unit of claim 1, wherein the target area has a convex topography, is bow shaped, and/or is designed in an arched manner;

a topography of the target area compensates for an axial rotation movement of the piston; and/or an air gap between the sensor probe and the target is substantially independent of piston axial rotation within ±3° of an un-rotated and/or initial piston position.

4. The variable displacement reciprocating piston unit of claim 1, wherein:

a sensor including the sensor probe and the processing unit is an eddy current sensor; and/or the signal of the sensor probe is directly measured or derived from a demodulation and/or a signal processing.

5. The variable displacement reciprocating piston unit of claim 4, wherein the sensor probe includes a sensor coil, the sensor coil is a flat wound coil on a bobbin and/or a flat coil on a PCB in one or more layers.

6. The variable displacement reciprocating piston unit of claim 5, wherein the sensor coil has a transmitting coil and a receiving coil that are either wound coils or PCB coils on different layers, and/or a resonance signal of the sensor probe is induced in the receiving coil and either a voltage, a current, a frequency, or a phase shift is processed in order to create a demodulated signal.

7. The variable displacement reciprocating piston unit of claim 1, wherein the sensor probe is located to indicate the presence of the target in top dead center position, and to indicate the absence of the target in the bottom dead center position.

8. The variable displacement reciprocating piston unit of claim 1, wherein:

a map translating and/or linearizing from the target duty cycle ratio to the stroke length is used to derive the stroke length from the target duty cycle ratio;

the map includes at least one functional relationship including at least one polynomial function, at least one trigonometric function, and/or a look-up table; and at least one functional relationship is stored in the look-up table.

9. The variable displacement reciprocating piston unit of claim 1, further comprising a calibration target, the sensor probe indicating a presence and an absence of the calibration target as the calibration target moves relative to the sensor probe, the processing unit is configured to calibrate the stroke length of the piston using the indication of the presence of the calibration target, the calibration target is located on the piston.

10. The variable displacement reciprocating piston unit of claim 9, wherein calibrating the stroke length includes generating a calibration duty cycle ratio from a calibration timestamp measured when the calibration target moves from being absent from the sensor probe to being present at the sensor probe, or when the calibration target moves from being present at the sensor probe to being absent from the sensor probe, the calibration timestamp is compared with the first and/or second timestamps to derive a calibration duty cycle using the relationship:

$$DC_{cal} = \frac{t_2 - t_1}{t_4 - t_1}$$

where $DC_{cal}$ is the calibration duty cycle, $t_1$ and $t_4$ are a pair of raising or falling edges of the signal from the sensor probe, and $t_2$ is a raising or falling edge of the calibration target.

11. The variable displacement reciprocating piston unit of claim 10, wherein calibrating the stroke length further includes correcting the target duty cycle ratio with a correcting factor or a correction function, the correcting factor or the correction function derived from the calibration duty cycle ratio and the target duty cycle, and a pre-stored accurate correlation between calibration duty cycle ratio and target duty cycle, the correcting factor or the correction function is applied to a map translating from target duty cycle ratio to stroke length.

12. The variable displacement reciprocating piston unit of claim 9, wherein calibrating the generated stroke length is performed when the piston stroke length is above a minimum stroke length required for the sensor probe to indicate the presence of the calibration target, during compressor and/or vehicle end-of-line test or during normal operations and with a certain time interval or at vehicle start-up.

13. The variable displacement reciprocating piston unit of claim 12, wherein the minimum stroke length required for the sensor to indicate the presence of the calibration target is greater than ⅔ of maximum stroke length.

14. The variable displacement reciprocating piston of claim 9, wherein the calibration target is indicated by a change of current carrying capacity and/or change of a piston topography, the change of current carrying capacity is the result of the change of topography, the change of topography includes one or more of: an air gap in the piston, a recess in the piston, a groove on the piston, a slope or edge of the piston, or a hole of the piston.

15. The variable displacement reciprocating piston of claim 14, wherein the calibration target is an oil groove in the piston.

16. The variable displacement reciprocating piston of claim 9, wherein the presence of the calibration target is distinguishable from the presence of the target using:

an uncalibrated piston stroke length information;

a difference in time between two calibration target frequency changes compared to the time between a main target frequency change and a calibration frequency change; or a difference in frequency and/or phase shift change between the target and the calibration target generated by a difference in topography and/or material leading to a different induced eddy current as the target and the calibration target moves relative to the sensor probe.

17. The variable displacement reciprocating piston of claim 1, wherein generating the signal indicating the stroke speed and the stroke length includes a linearization of the target duty cycle, and the target duty cycle ratio is given by the equation:

$$DC_{rel} = \frac{\text{On_time}}{\text{Off_time}} = \frac{1}{\frac{\text{Period}}{\text{On_time}} - 1}$$

where pulse width ON_time is a time duration where the sensor probe is indicating the presence of the target, and the OFF_time is a time duration where the sensor probe is indicating the absence of the target.

* * * * *